US011331673B2

(12) United States Patent
Cahilly

(10) Patent No.: US 11,331,673 B2
(45) Date of Patent: May 17, 2022

(54) REAGENT MANAGEMENT APPARATUS

(71) Applicant: Bambi Lyn Cahilly, Las Vegas, NV (US)

(72) Inventor: Bambi Lyn Cahilly, Las Vegas, NV (US)

( * ) Notice: Subject to any disclaimer, the term of this patent is extended or adjusted under 35 U.S.C. 154(b) by 163 days.

(21) Appl. No.: 16/559,270

(22) Filed: Sep. 3, 2019

(65) Prior Publication Data

US 2021/0060562 A1 Mar. 4, 2021

(51) Int. Cl.
*B01L 3/00* (2006.01)

(52) U.S. Cl.
CPC ..... *B01L 3/52* (2013.01); *B01L 2200/06* (2013.01); *B01L 2200/16* (2013.01); *B01L 2300/047* (2013.01); *B01L 2300/0809* (2013.01); *B01L 2300/123* (2013.01); *B01L 2300/16* (2013.01)

(58) Field of Classification Search
CPC ..... B01L 3/52; B01L 3/50; B01L 3/00; B01L 2200/06; B01L 2200/00
USPC ..... 422/555, 547, 500
See application file for complete search history.

(56) References Cited

U.S. PATENT DOCUMENTS 7,811,522 B2 * 10/2010 Mathus ..... B01L 3/508 422/400
2011/0180552 A1 * 7/2011 Sarson ..... B65D 21/0233 220/592.16

FOREIGN PATENT DOCUMENTS

EP 3 789 309 A1 * 3/2021 ..... B65D 25/16

OTHER PUBLICATIONS

Capp, CappOrigami reservoir—Capp—PDF Catalogs | Technical Documentation, access from https://pdf.medicalexpo.com/pdf/capp/capporigami-resevoir/67943-129300.html, on Feb. 23, 2021, pp. 1-24. (Year: 2021).*
Internet Archive, Wayback Machine, https://web.archive.org/web/2017*/http://www.capp.dk/sites/default/files/Capp%20Origami.pdf, accessed May 19, 2021. (Year: 2021).*
CappOrigami™., https://www.capp.dk/sites/default/files/Capp%20Origami.pdf, Feb. 15, 2017, pp. 1-2. (Year: 2017).*

* cited by examiner

*Primary Examiner* — Christine T Mui
(74) *Attorney, Agent, or Firm* — Theodore J. Bielen, Jr.

(57) ABSTRACT

A reagent management apparatus utilizing a flexible sheet that is foldable along scores into a disposable liner which may be freestanding via a "three point" structure. The disposable liner includes a reservoir for reagents and allows the pouring off of unused reagent into a storage container. The disposable liner may be used with a permanent base in certain cases.

18 Claims, 4 Drawing Sheets

REAGENT MANAGEMENT APPARATUS

BACKGROUND OF THE INVENTION

Liquid reagent reservoirs have been used in laboratories engaging in research and clinical applications. It is also known that reagent reservoirs may be formed in two parts consisting of a base and a disposable insert. Disposable inserts are quite useful in that they are discarded after use to prevent the need to clean and/or sterilize the same when varied reagents are employed.

In addition, reagent reservoirs are normally fashioned to accommodate eight or twelve channel pipette mechanisms that are used to transfer reagent into microplates or microtubes, for use in a laboratory or clinical research facility.

In the past, reagent reservoirs using a rigid base and disposable inserts have been proposed. For example, U.S. Pat. No. 7,811,522 describes a reagent reservoir kit that employs a reusable reservoir base and a disposable liner made of clear transparent plastic material. The disposable liner requires the use of the base as the liner is unable to stand vertically on a flat surface without such support.

U.S. Pat. No. 5,248,056 shows a reservoir body and a holder for the body. The reservoir is covered and provides an opening to allow the drawing of reagent from the reservoir in order to reduce evaporation and unwanted movement of the reagent material.

United States Patent Publication 2018/0353955 teaches a sample and reagent reservoir kit in which a disposable liner is supported by a base and includes anti-vacuum channels on the bottom of the liner to prevent pipette tip vacuum formation during aspiration of the liquid.

U.S. design Pat. 0824534 describes a reagent reservoir liner similar to that shown in United States Patent Publication 2018/0353955, including vacuum channels at the base of the liner.

An origami reagent reservoir is shown in a brochure issued by CAPP APS which discloses a flat sheet that is folded into a reservoir and that is supported by side flaps which extend below the bottom of the reservoir portion. The CAPP origami reservoir is formed of a relatively stiff plastic material by a flatbed non-rotary process and is self-supporting.

Other containers that are formable from sheet material have been devised. For example, U.S. Pat. No. 5,090,571 shows a medical container liner which is formed from a die cut foldable sheet into a tray having a lid and cooperative wall to enclose the tray device.

United States Patent Publication 2014/0069928 discloses a container liner that is used to house an animal and to collect animal waste, that is formed from a sheet of flat material.

United Kingdom Patent Application 2393951 reveals a disposable crate insert that is formed by folding side portions together and is also capable of unfolding into a collapsed configuration for storage.

United States Patent Publication 2004/0112902 delineates a paint tray liner system that is created from a flexible sheet and includes an adhesive layer on one side to fix the flexible sheet to a metallic paint tray. Reversal of the installation process allows the liner to be peeled away and disposed of after use.

There is a need for a reagent management apparatus in which a disposable liner may be used with a base or may be freestanding to allow containment and reuse of the expensive reagent material after interaction with a pipetting system.

SUMMARY OF THE INVENTION

In accordance with the present application, a novel and useful reagent management apparatus is herein provided.

The apparatus of the present application utilizes a pliable sheet of material to form an insert. The pliable sheets may be manufactured utilizing a rotary die, continuous high-speed web converting process. The insert includes six sections that may be scored from above and below the sheet to allow folding of the same into a self-supporting entity. Third and fourth sections take the form of flaps, each having a free end or perimeter that folds adjacent the reservoir. Notably, first and second sections, as well as fifth and sixth sections, fold or bend to form a reservoir for a reagent. The nadir of the reservoir and the free ends of the third and fourth flaps are capable of lying in a common plane and serve to self-support the insert on a flat surface. Graduations may be applied to the first and second sections to indicate a volume of liquid in the reservoir. The sheet may be formed of a water resistant material and possesses a hydrophilic surface. The formed insert is capable of holding a reagent and allowing recovery of unused reagent through any of a multiplicity of pouring spouts, formed by the fifth and sixth sections of the pliable sheet. In addition, the fourth and fifth sections may be partially severed or cut to allow egress of viscous or powdered materials from the reservoir.

In addition, the disposable insert, heretofore described, may be employed with a base which may be constructed of a permanent material, such as plastic and the like. The base includes a trough which accommodates the reservoir formed by the first and second sections of the pliable sheet used to form the disposable insert. The base further provides at least first and second slots for encompassing the free edges of the third and fourth sections of a certain sized pliable sheet. Moreover, additional third and fourth slots, of different dimensions from the first and second slots, may be formed adjacent first and second slots in the base to accommodate free edges of the third and fourth sections of inserts of a different size formed from a pliable sheet. Thus, it should be realized that the first and second slots and third and fourth slots of the base are capable of supporting disposable inserts having reservoirs of varying sizes formed from pliable sheets. The slots may also be constructed with protrusions to aid in the loading, insertion, and/or holding of a disposable insert in any of the slots of the base. Tabs may also be found on the base to further enhance the manual maneuverability of the same, including the provision of stability when pouring liquid from an insert mounted in the base. Moreover, any graduation lines on the first and second sections forming the reservoir of any insert will more accurately reflect the volume of liquid therein when the base is combined with such insert.

It may be apparent that a novel and useful reagent management apparatus has been hereinabove described.

It is therefore an object of the present application to provide a reagent management apparatus that includes an insert formed from a pliable sheet that may be employed in a free-standing configuration or with a base.

Another object of the present application is to provide a reagent management apparatus that includes a disposable insert and a permanent, reusable base.

Another object of the present application is to provide a reagent management apparatus that utilizes disposable inserts formed from a continuous roll of flexible material that is rotary die cut via a continuous, high-speed, web converting process.

A further object of the present application is to provide a reagent management apparatus that may be used with a permanent base and is capable of accommodating or supporting disposable inserts of various sizes.

Another object of the present application is to provide a reagent management apparatus that utilizes disposable inserts that are easily stored in a flat configuration and assembled into a reagent holding configuration of a particular volumetric size by folding the same via score lines formed in the pliable sheet.

Another object of the present application is to provide a reagent management apparatus that employs a pliable sheet that is easily folded to form an insert with a liquid containing reservoir and maintain its folded configuration.

Another object of the present application is to provide a reagent management apparatus that employs disposable inserts formed of recyclable material.

Another object of the present application is to provide a reagent management apparatus that employs a disposable insert constructed of material exhibiting chemical resistance, and/or water resistance, and which possesses a low liquid retention surface characteristic.

A further object of the present application is to provide a reagent management apparatus that uses an insert which may be combined with a supporting base or that is free-standing, exhibiting three point stability.

Another object of the present application is to provide a reagent management apparatus that employs a flexible insert and a base that includes an opening and trough side portions to aid in the creasing of the pliable insert and promotes formation of a reservoir for reagent material.

A further object of the present application is to provide a reagent management apparatus that has a disposable insert and a base with a plurality of slots to support the insert as well as protrusions in the slots of the base to aid in the loading, insertion, and/or holding of the insert in place.

A further object of the present application is to provide a reagent management apparatus that employs a foldable, disposable insert that mates with a permanent base element such that the insert may include reservoir graduations that are visible and accurate once the insert and base are assembled.

Another object of the present application is to provide a reagent management apparatus that includes a disposable insert in combination with a permanent base portion and is formed with pouring at least one spout that allows the efficient recovery of unused reagent in a reservoir formed by the disposable insert.

Yet another object of the present application is to provide a reagent management apparatus that includes a disposable insert that is scored by the use of a rotary die apparatus facilitating the folding of the insert to create a reservoir to hold reagent material.

Another object of the present application is to provide a disposable insert for holding liquid formed from synthetic paper or like material exhibiting similar folding and rigidity characteristics.

The application possesses other objects and advantages especially as concerns particular characteristics and features thereof which will become apparent as the specification continues.

For a better understanding of the application, reference is made to the following detailed description of the preferred embodiments thereof which should be referenced to the prior described drawings.

DETAILED DESCRIPTION OF THE PREFERRED EMBODIMENTS

Various aspects of the present application will evolve from the following detailed description of the preferred embodiments thereof which should be referenced to the prior described drawings.

Figure 1:
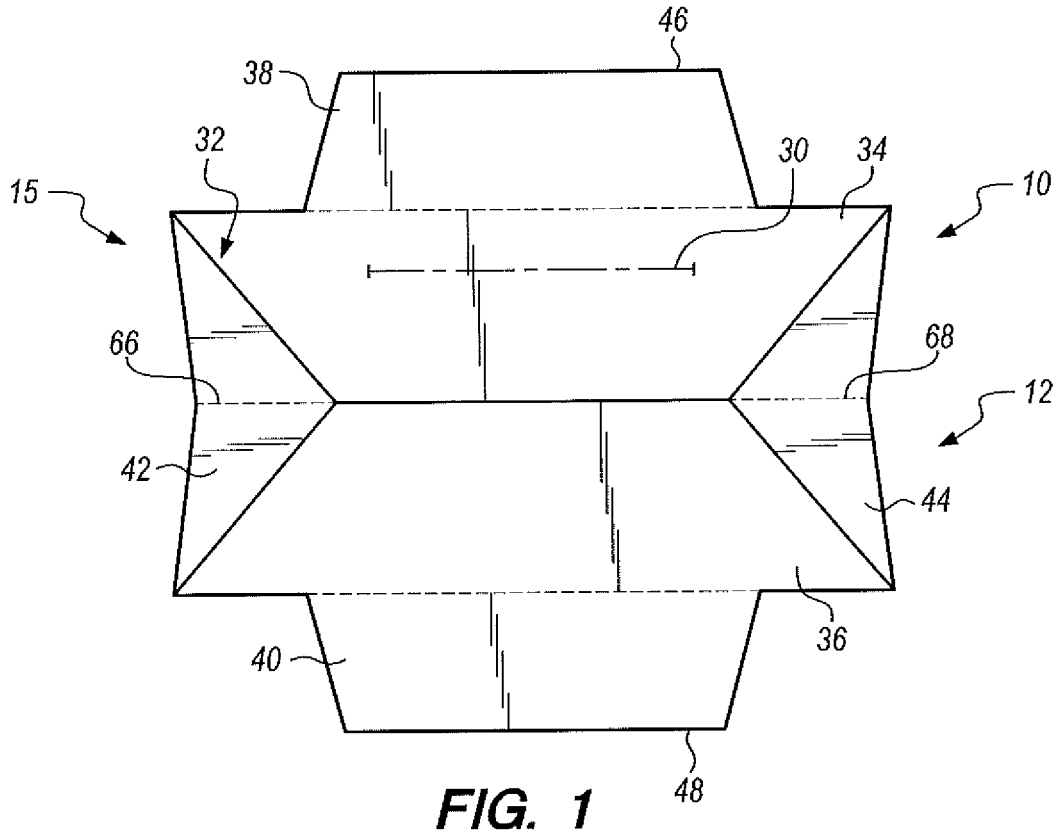
FIG. 1 is a top plan view of a scored pliable sheet used to form a disposable insert having an eight channel reservoir.
Figure 2:
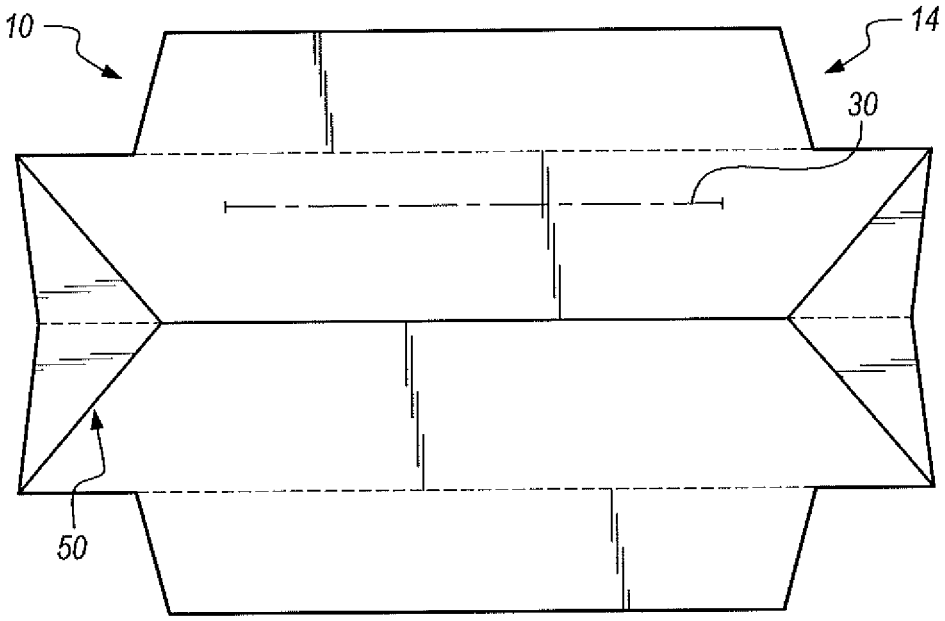
FIG. 2 is a top plan view of a scored pliable sheet used to form a disposable insert having a twelve channel reservoir.

The invention as a whole is depicted in the drawings by reference character 10. The reagent management apparatus 10 employs flexible sheets such as those shown in FIGS. 1 and 2 as sheets 12 and 14. Sheet 12 is intended to form a disposable insert of an eight channel size while flexible sheet 14, FIG. 2 is intended to form a disposable insert of a twelve channel size. The eight and twelve channel sizes correspond to manual or automatic pipetting apparatuses which are used to draw reagent from the reservoirs of disposable inserts eventually formed by sheets 12 and 14, which will be discussed in greater detail as the specification continues.

Figure 10:
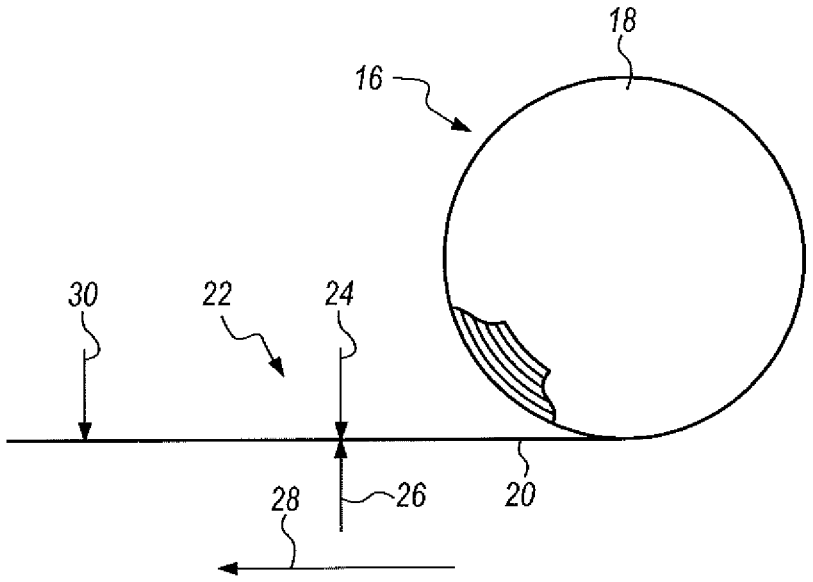
FIG. 10 is a schematic view depicting the formation of the sheets from a web depicted in FIG. 1 or 2 using a rotary die cutting apparatus.

Sheets 12 and 14 may be created by a rotary die cutting apparatus 16, depicted schematically in FIG. 10. The rotary die cutting apparatus 16 utilizes a roll or web of material 18 that presents a working piece 20. A die set 22 includes a male die 24 and an opposite female die 26 represented by arrows on FIG. 10. It should be realized that rotary die cutting and forming is known in the prior art. The male and female dies 24 and 26 impart scores or partial cuts through working sheet 20 and may also produce the perimeter formation or cuts of the flexible sheets 12 and 14 depicted in FIGS. 1 and 2. Male and female dies 24 and 26 may be oriented oppositely as depicted in FIG. 10. Directional arrow 28 shows the movement of working sheet 20 while 30 indicates the cutting of a particular flexible piece 20 of FIG. 1 or 2 originating with web 18. Perimeter cutting and scoring of sheet 20 may be effected in a single operation or separately.

In essence, the flexible sheets 12 and 14 are scored from the top and bottom through the rotary die cutting apparatus 16. In any case, the flexible sheets of FIGS. 1 and 2 are depicted with a plurality of scores 15, each score being depicted by either a solid line or a dashed line. Specifically, the solid lines on flexible sheets 12 and 14 of FIGS. 1 and 2 indicate scoring from the top. On the other hand, the dashed lines indicate scoring of sheets 12 and 14 from underneath, i.e. the side opposite that shown in FIGS. 1 and 2. The dashed dot line 30 shows a score line which is intended to serve as indicia for the level of reagent in a reservoir which is produced from sheets 12 and 14, which will be discussed hereinafter. Although only score line 30 appears on FIGS. 1 and 2, respectively, for such indicia, multiple lines may be applied to sheets 12 or 14 to indicate various levels in the reservoir to be found in the disposable insert derived from sheets 12 and 14. Also, a topical marking or imprinting may be substituted for score line 30.

Also, the rotary die cutting apparatus 16 of FIG. 10 may employ heat in the cutting process to obtain a smoother cut and to extend the longevity of the rotary die cutting tool 16.

It is anticipated that the flexible sheets 12 and 14 may originate from as a polymer-based material, known generically as synthetic paper. Synthetic paper provides excellent foldability, stiffness, and durability as well as moisture and chemical resistance. However, traditional polymeric material may also be used, such as un-altered polypropylene or polystyrene. It is further anticipated that flexible sheets 12 and 14 will possess a thickness of between eight and ten mils when synthetic paper is employed. In contrast, prior art disposable inserts are formed of polypropylene by injection molding, thermoforming, and the like and possess a thickness of between sixteen and twenty-two mils.

Again returning to FIGS. 1 and 2, it may be observed that flexible sheets 12 and 14 include a plurality of scores 15 imparted at either the top surface or from underneath or a combination thereof. Specifically, flexible sheet 12 of FIG. 1 is shown with a plurality of top and bottom scores 32 resulting in a plurality of sections. First and second sections 34 and 36 lie opposite one another. Third and fourth sections 38 and 40 connect to first and second sections, respectively. In addition, fifth and sixth sections 42 and 44 connect to first and second sections. As heretofore delineated, sections 34, 36, 38, 40, 42, and 44 are separated by scores as depicted in FIG. 1. It should also be realized that third section 38 includes a free edge or perimeter 46 while fourth section 40 also possesses a free edge or perimeter 48. Needless to say, the flexible sheet 14 used to form a larger twelve channel insert is similarly scored to that shown with respect to flexible sheet 12 used to form a smaller eight channel insert. In this regard, flexible sheet 14 includes a multiplicity of scores 50 and the sections formed thereby will not be further described as they are similar to that shown with respect to flexible sheet 12 of FIG. 1.

Figure 3:
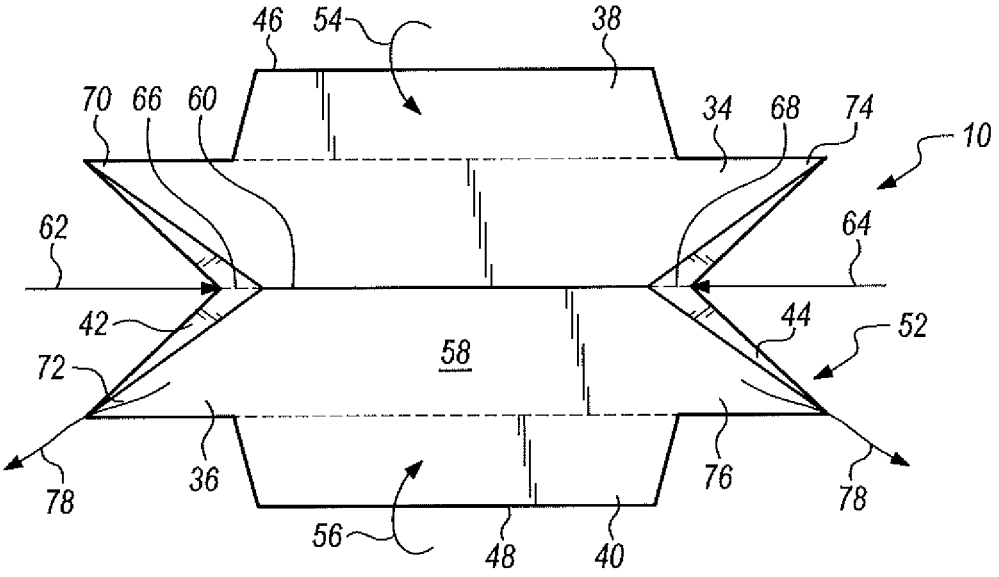
FIG. 3 is a top plan view of a folded pliable sheet depicted in FIG. 1.

Turning now to FIG. 3, flexible sheet 12 has been fashioned into a disposable insert 52. Such shaping is achieved by folding first and second sections relative to one another by the exertion of force on first and second sections 34 and 36, indicated by force lines 54 and 56. A trough 58 is created in this manner having a nadir or low point 60. Third and fourth sections 38 and 40 have been folded downwardly according to directional arrows 54 and 56. In addition, fifth and sixth sections 42 and 44 have been pushed inwardly to form the ends of trough or reservoir 58. Such folding is indicated by directional arrows 62 and 64. Fifth and sixth sections 42 and 44 are also each folded upon themselves along fold lines 66 and 68. It should be noted that tips 70, 72, 74, and 76 have been created by the folding of flexible sheet 12 in the formation of trough or reservoir 58. Tips 70, 72, 74, and 76 extend outwardly from reservoir 58, specifically third and fourth sections 38 and 40, thereof. By example, tip 72, extended from reservoir 58 and fourth section 40, may be employed as a spout to recover unused reagent from trough or reservoir 58 according to directional arrow 78. Likewise, tips 70, 72, and 74 may be used as pouring spouts for emptying reagent from reservoir 58.

Figure 5:
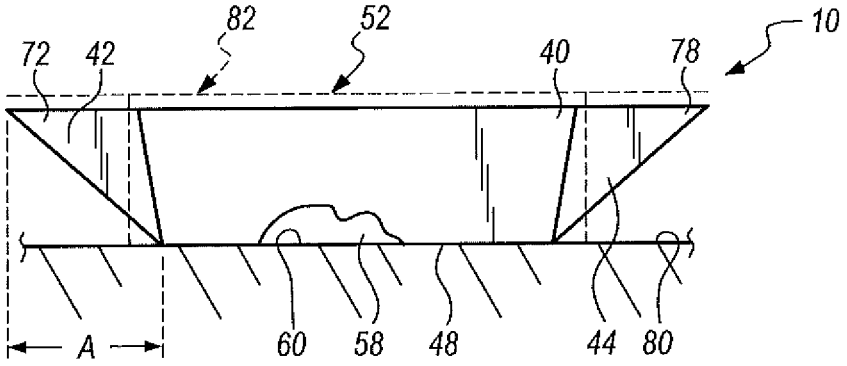
FIG. 5 is a front elevational view of the folded insert of FIG. 3.

It should be noted that a gap or space "A", FIG. 5, separates the end of tip 72 from perimeter 48 of fourth section 40. The same relationship exists between tip 70 and perimeter 46 of third section 38, tip 74 and perimeter 46 of third section 38, and tip 76 and perimeter 40 of fourth section 40. It has been found that gap "A" prevents the dribbling of liquid from reservoir 58 along fourth section 40 when tip 72 is used as a pouring spout. The same advantage applies when tips 72, 74, or 76 are used as pouring spouts.

Figure 4:
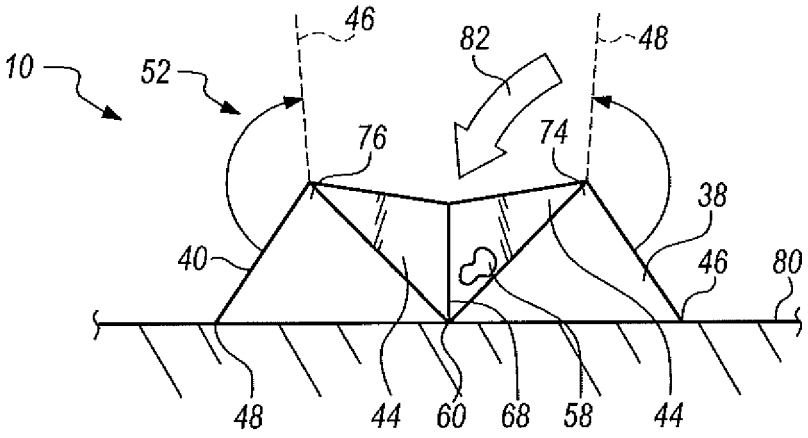
FIG. 4 is a right end view of the folded insert depicted in FIG. 3.

With reference to FIGS. 4 and 5, it may be observed that disposable insert 52 is capable of being self-supporting on a flat plane or surface 80. Thus, liquid being transferred into reservoir 58, directional arrow 82, FIG. 4, will safely be retained in reservoir 58 due to the stability of disposable insert 52. Such stability derives from the contact of perimeter or free edge 46 of third section 38, perimeter or free edge 48 of fourth section 40, and the nadir 60 between first and second sections 34 and 36. Such "three point" support on plane 80 is clearly shown in FIG. 4. Thus, disposable insert 52 may also be employed as a weigh boat for determining the quantity of reagent lying within trough or reservoir 58. In addition, a flexible sheet similar to flexible sheet 12 may be folded such that third and fourth sections 46 and 48 are pivoted upwardly, as shown in FIG. 4. In this configuration, a flexible sheet similar to flexible sheet 12 may serve as a cover 82 for dispensable insert 52. The use of a flexible sheet similar to flexible sheet 12 in the formation of cover 82 is depicted in FIGS. 4 and 5 by dashed lines.

Figure 6:
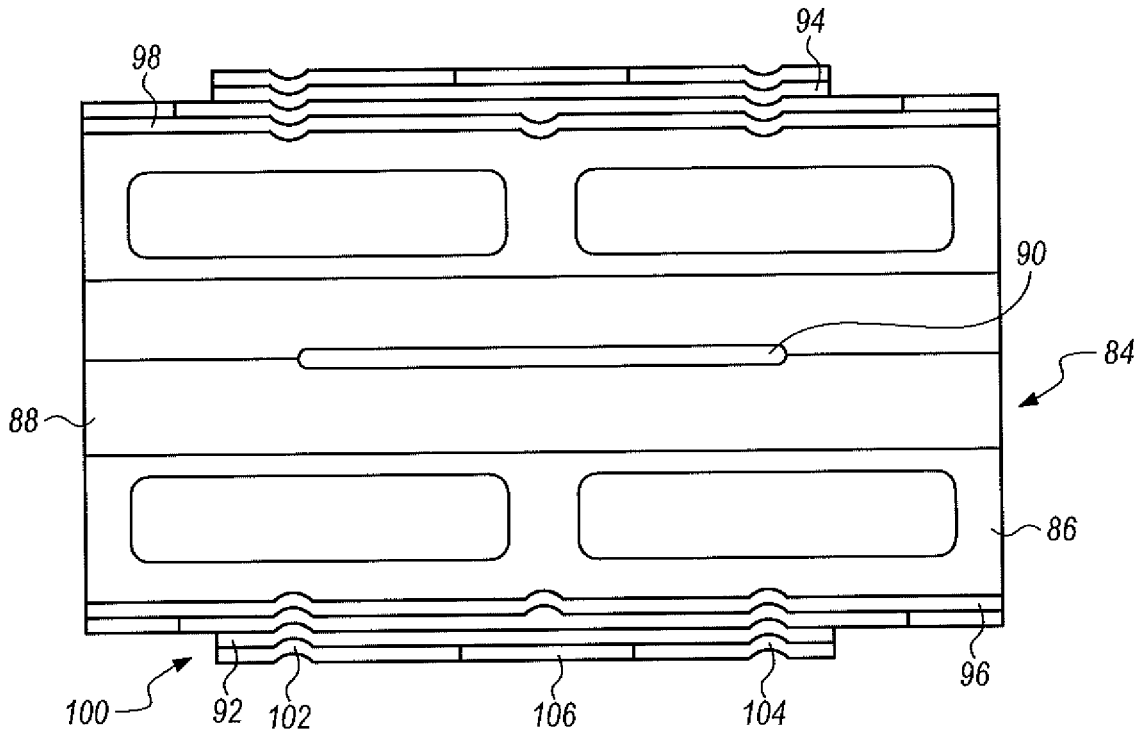
FIG. 6 is a top plan view of the base which may be employed with the folded disposable insert depicted in FIGS. 3-5.
Figure 7:
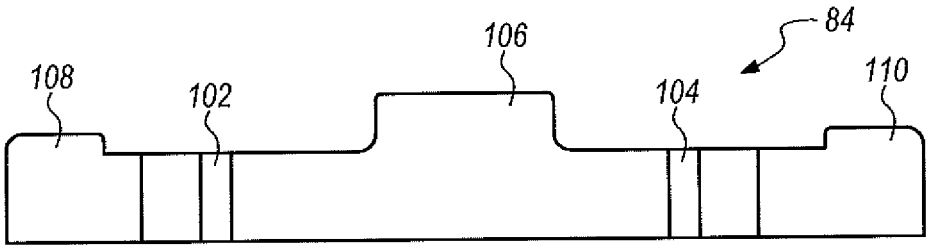
FIG. 7 is a front elevational view of the base depicted in FIG. 6.
Figure 8:
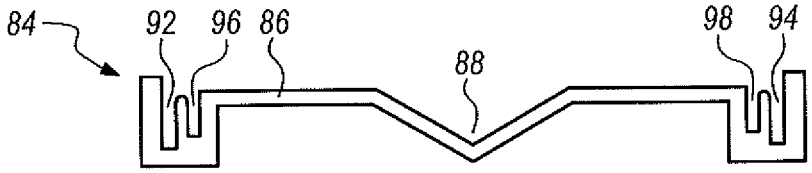
FIG. 8 is a right end view of the base depicted in FIG. 6.

With reference now to FIGS. 6-8, it may be seen that a base 84 is depicted. Base 84 may be constructed of a relatively rigid plastic material such as polycarbonate. Base 84 is intended to be used with disposable insert 52 and reused with like disposable inserts. Base 84 includes a rigid frame 86 that forms a V-shaped depression 88 to accommodate the trough 58 of disposable insert 52. In addition, a channel or opening 90 through frame 86 at depression 88 aides in the creasing of flexible sheet, 12 to form disposable insert 52. First and second sections 34 and 36 support in this endeavor by bringing tips 72, 74, 76, and 78 together before passing through channel 90. In other words, the entire flexible sheet 12 may be initially passed through channel 90 in this regard. Further, base 84 is provided with slots 92 and 94 to hold third section 38 and fourth section 40 of disposable insert 52 in its folded configuration shown in FIGS. 3-5. Likewise, longer slots 96 and 98 in frame 86 of base 84 are configured to accept similar sections of flexible sheet 14 when it is assembled into the large twelve channel disposable insert. It should be noted that flexible sheet 14 is assembled in a similar manner to that shown with respect to flexible sheet 12 in FIGS. 3-5. A plurality of protrusions 100 extend into slots 92, 94, 96, and 98 to frictionally hold disposable insert 52 and a similar insert assembled from flexible sheet 14. By way of example, protrusions 102 and 104 bear against fourth section 40 of insert 52 within slot 92. With reference to FIG. 7, it may be apparent that handle 106 and tabs 108 and 110 are provided on base 84 to allow the user to easily grip base 84. Further, it should be noted that slots 92 and 94 are shorter in length than slots 96 and 98 to allow identification by the user of base 84 of slots 92 and 94 to properly position small insert 52 formed from flexible sheet 12. Likewise, slots 96 and 98 are easily acquired to place a larger insert formed from flexible sheet 14. It should also be apparent that the plurality of protrusions 100 have been omitted from FIG. 8 for the sake of clarity.

Figure 9:
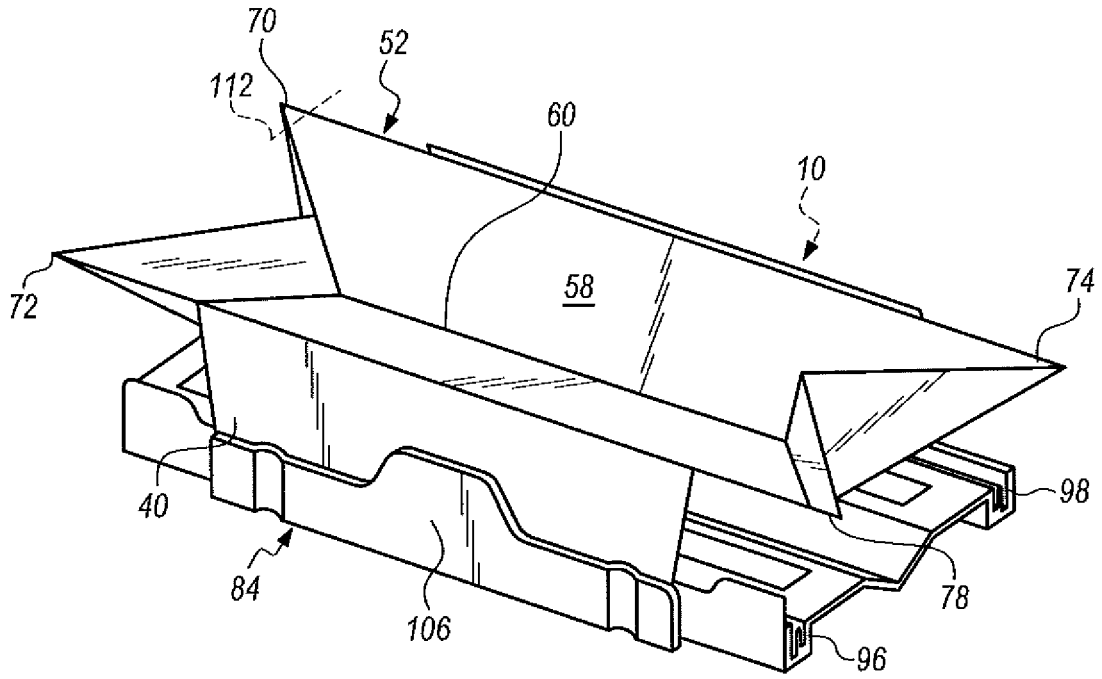
FIG. 9 is an isometric view of the folded, assembled insert depicted in FIG. 3 mated with the base depicted in FIGS. 6-8.

FIG. 9 represents the mating of a small disposable insert 52 formed from sheet 12 with base 84 when such insert 52 is not used in its freestanding configuration shown in FIGS. 3-5. Moreover, FIG. 9 indicates that tip 70 may be cut along cut line 112 to permit the pouring of viscous or powdered material from trough 58. Of course, tips 72, 74, or 76 may also be cut in a similar manner as needed. Such cutting of any of tips 70, 72, 74, or 76 may be facilitated when sheet 12 or 14 is in a flattened configuration.

In operation, the user obtains flexible sheets 12 or 14 from a rotary die cut apparatus 16 and folds the same according to the score lines indicated on either FIG. 1 or 2. In the case of flexible sheet 12, once disposable insert 52 is formed according to FIG. 3, reservoir or trough 58 may be employed to hold reagent material using insert 52 as a freestanding entity, FIG. 4 or 5, or in conjunction with base 84. The latter is accomplished by employment of slots 92 and 94 in base 84 in conjunction with third section 38 and fourth section 40 in the case of flexible sheet 12. Insert 52 may be loaded into the slots 92 and 94 of base 84 in a top-down maneuver or by sliding insert 52 into slots 92 and 94. When an insert is formed from flexible sheet 14 to form a 12-channel insert, slots 96 and 98 of base 84 are similarly used. Tab 106 aids the user in this endeavor. Excess expensive reagent may be poured from reservoir 58 into a storage container for reuse.

While in the foregoing embodiments of the application have been set forth in considerable detail for the purpose of making a complete disclosure of the application, it may be apparent to those of skill in the art that numerous changes may be made in such detail without departing from the spirit and principles of the application.

What is claimed is:

1. A reagent management apparatus for a reagent, comprising:

an insert, said insert including a pliable sheet comprising first and second sections connected to one another and being foldable relative to one another, a third section being connected to said first section and a fourth section being connected to said second section, said first and third sections and said second and fourth sections being foldable relative to one another, a fifth section and a sixth section each being foldable and connected to said first and second sections, respectively, said folded first and second sections and folded fifth and sixth sections forming a reservoir for the reagent, said third and fourth sections each having a longitudinal dimension less than said connected first, second, fifth, and sixth sections, said third and fourth sections each including a free edge, said reservoir further including a nadir, said third and fourth sections being folded toward said nadir, and said at least fifth section extending outwardly from said reservoir and from said fourth section, forming a pouring spout; and a base, said base comprising a trough accommodating said reservoir formed by said first and second sections of said insert, said base further including at least a first and a second adjacent slot for encompassing said free edges of said third and fourth sections, respectively, and adapted for extending said insert outwardly from said base.

2. The apparatus of claim 1 in which said fifth section extending outwardly from said reservoir further forms a gap between said fifth section and said free edge of said fourth section.

3. The apparatus of claim 1 in which at least one of said first and second slots includes a protrusion capable of contacting said insert.

4. The apparatus of claim 1 in which said base further includes an elongated opening positioned adjacent said folded first and second sections.

5. The apparatus of claim 1 in which said base further includes third and fourth slots for encompassing said free edges of said third and fourth sections, said third and fourth slots lying adjacent said first and second slots, respectively.

6. The apparatus of claim 5 in which said insert pliable sheet is composed of water resistant material.

7. The apparatus of claim 5 in which said base comprises at least one tab projecting outwardly therefrom.

8. The apparatus of claim 5 in which said insert pliable sheet further comprises scores located between said first and second sections, said third and first sections, and said fourth and second sections, said scores being formed by a rotary die cutting device.

9. The apparatus of claim 8 in which said scores formed by the rotary die cutting device are located on multiple sides of said pliable sheet.

10. A management device for a reagent, comprising:

a free standing element comprising a pliable sheet having first and second sections connected to one another and being foldable relative to one another, a third section being connected to said first section and a fourth section being connected to said second section, said first and third sections and said second and fourth sections being foldable relative to one another respectively, a fifth section and a sixth section each connected to said first and second sections, said fifth and sixth sections being foldable relative to said folded first and second sections, to form a reservoir for the reagent, said first and second sections forming an apex when folded relative to one another, said third and fourth sections each being foldable toward said apex, each of said third and fourth sections including a free edge with a longitudinal dimension, said free edges of said third and fourth sections and said apex formed by said folded first and second sections, being capable of lying in a common plane and forming a three point support at said common plane; and at least said fifth section extending outwardly along and beyond said longitudinal dimension of said free edge of said fourth section and terminating in one tip, said one tip creating a longitudinal gap separating said free edge of said fourth section from said one tip, said outwardly extending fifth section forming a first reagent pouring spout.

11. The device of claim 10 in which said fifth section extends outwardly along and beyond said longitudinal dimension of said free edge of said third section terminating in another tip, said another tip creating a gap separating said free edge of said third section from said another tip, said outwardly extending fifth section forming a second reagent pouring spout.

12. The device of claim 10 in which said free standing element is composed of water resistant material.

13. The device of claim 10 in which said free standing element pliable sheet further comprises scores located between said first and second sections, said third and first sections, and said fourth and second sections, said scores being formed by a rotary die cutting device.

14. The device of claim 13 in which said scores formed by the rotary die cutting device are located on multiple sides of said pliable sheet.

15. The device of claim 12 in which said water resistant material comprises synthetic paper or a polymeric material.

16. A process of creating a management apparatus for a reagent comprising the steps of:

rotary die cutting a pliable sheet from a web from pliable material;

scoring said pliable sheet to provide first and second sections connected to one another and being foldable relative to one another;

scoring said pliable sheet to provide a third section being connected to said first section and a fourth section being connected to said second section, said third and fourth sections each having a free edge, said first and third sections and said second and fourth sections being foldable relative to one another, respectively, to form said reservoir for the reagent, said reservoir having an apex;

scoring said pliable sheet to provide a fifth and a sixth section connected to said first and second sections, respectively, said fifth and sixth sections being foldable relative to said first and second sections, respectively, to form a portion of said reservoir;

folding said third and fourth sections relative to said first and second sections, respectively, to position said free edges of said third and fourth sections, respectively, in a coplanar relationship with the apex of said reservoir; and providing said pliable sheet of water resistant material.

17. The process of claim 16 in which said step of providing said pliable sheet of water resistant material comprises providing said water resistant material as synthetic paper or a polymeric material.

18. The process of claim 16 which includes an additional step of mounting said third and fourth sections to a base.

* * * * *